US011170689B2

(12) United States Patent
Pyo et al.

(10) Patent No.: US 11,170,689 B2
(45) Date of Patent: Nov. 9, 2021

(54) SOURCE DRIVER AND DISPLAY DEVICE INCLUDING THE SAME

(71) Applicant: SAMSUNG DISPLAY CO., LTD., Yongin-si (KR)

(72) Inventors: Si Beak Pyo, Yongin-si (KR); Seung Kyu Lee, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/741,104

(22) Filed: Jan. 13, 2020

(65) Prior Publication Data

US 2020/0265769 A1 Aug. 20, 2020

(30) Foreign Application Priority Data

Feb. 19, 2019 (KR) ..... 10-2019-0019335

(51) Int. Cl.
*G09G 3/20* (2006.01)

(52) U.S. Cl.
CPC ... *G09G 3/2003* (2013.01); *G09G 2320/0673* (2013.01)

(58) Field of Classification Search
CPC ..... G09G 3/2003; G09G 2320/0673; G09G 2320/021; G09G 2340/0435; G09G 2320/0276; G09G 23/16
USPC ..... 345/691
See application file for complete search history.

(56) References Cited

U.S. PATENT DOCUMENTS

| | | | | |
|---|---|---|---|---|
| 7,783,105 | B2 | 8/2010 | Moore et al. | |
| 10,049,617 | B2 | 8/2018 | Shin et al. | |
| 2004/0246537 | A1* | 12/2004 | Ohyama | H04N 5/202 358/479 |
| 2009/0195550 | A1* | 8/2009 | Wang | G06F 3/14 345/589 |
| 2013/0278569 | A1* | 10/2013 | Choi | G09G 5/003 345/204 |
| 2015/0103104 | A1* | 4/2015 | Lee | G09G 3/3648 345/690 |
| 2016/0104408 | A1* | 4/2016 | Kim | G09G 3/36 345/690 |
| 2016/0365024 | A1* | 12/2016 | Pyo | G09G 3/3233 |
| 2017/0124958 | A1 | 5/2017 | Pyo et al. | |
| 2019/0362665 | A1* | 11/2019 | Chang | H01L 27/0296 |

FOREIGN PATENT DOCUMENTS

| | | |
|---|---|---|
| KR | 10-1297793 | 8/2013 |
| KR | 10-2017-0023359 | 3/2017 |

* cited by examiner

*Primary Examiner* — Kent W Chang
*Assistant Examiner* — Sujit Shah
(74) *Attorney, Agent, or Firm* — F. Chau & Associates, LLC

(57) ABSTRACT

A source driver includes a gamma voltage generation circuit. The gamma voltage generation circuit generates a gamma voltage and varies a gamma voltage based on a drive frequency. A data voltage generation circuit generates a data voltage based on the gamma voltage.

17 Claims, 8 Drawing Sheets

FIG. 4B

| GRAY | W_BR | V_DATA | | | | | | | | |
|---|---|---|---|---|---|---|---|---|---|---|
| | | RV_DATA | | | GV_DATA | | | BV_DATA | | |
| | | 60Hz | 85Hz | delta | 60Hz | 85Hz | delta | 60Hz | 85Hz | delta |
| 255 | 1000.000 | 2.2586 | 2.5993 | 0.3406 | 2.7643 | 3.1302 | 0.3659 | 1.8070 | 2.1090 | 0.3020 |
| 203 | 605.484 | 2.6892 | 3.0500 | 0.3608 | 3.1436 | 3.5192 | 0.3756 | 2.2632 | 2.5868 | 0.3236 |
| 151 | 315.763 | 3.1192 | 3.5021 | 0.3829 | 3.5281 | 3.9197 | 0.3916 | 2.7207 | 3.0715 | 0.3508 |
| 87 | 93.876 | 3.7261 | 4.1299 | 0.4038 | 4.0738 | 4.4869 | 0.4131 | 3.3669 | 3.7488 | 0.3819 |
| 51 | 28.991 | 4.1878 | 4.6038 | 0.4160 | 4.4884 | 4.9136 | 0.4252 | 3.8593 | 4.2590 | 0.3997 |
| 35 | 12.664 | 4.4579 | 4.8857 | 0.4278 | 4.7315 | 5.1644 | 0.4329 | 4.1484 | 4.5625 | 0.4141 |
| 23 | 5.028 | 4.7204 | 5.1591 | 0.4387 | 4.9649 | 5.4033 | 0.4384 | 4.4274 | 4.8567 | 0.4293 |
| 11 | 0.992 | 5.1520 | 5.5732 | 0.4212 | 5.3118 | 5.7354 | 0.4236 | 4.8592 | 5.2896 | 0.4304 |

FIG. 6

TABLE1

| DBV Band \|Nits\| | | Tab-Point | | | | | | | | | | | | | | | | | | | |
|---|---|---|---|---|---|---|---|---|---|---|---|---|---|---|---|---|---|---|---|---|---|
| 60Hz | 48Hz | 60Hz | | | | | | | | | | 48Hz | | | | | | | | | |
| 300 | 300 | 255 | 203 | 151 | 87 | 51 | 35 | 23 | 11 | 7 | 1 | 255 | 203 | 151 | 87 | 51 | 35 | 23 | 11 | 7 | 1 |
| 100 | 100 | 255 | 203 | 151 | 87 | 51 | 35 | 23 | 11 | 7 | 1 | 255 | 203 | 151 | 87 | 51 | 35 | 23 | 11 | 7 | 1 |
| 60 | 60 | 255 | 203 | 151 | 87 | 51 | 35 | 23 | 11 | 7 | 1 | 255 | 203 | 151 | 87 | 51 | 35 | 23 | 11 | 7 | 1 |
| 30 | 30 | 255 | 203 | 151 | 87 | 51 | 35 | 23 | 11 | 7 | 1 | 255 | 203 | 151 | 87 | 51 | 35 | 23 | 11 | 7 | 1 |
| 15 | 15 | 255 | 203 | 151 | 87 | 51 | 35 | 23 | 11 | 7 | 1 | 255 | 203 | 151 | 87 | 51 | 35 | 23 | 11 | 7 | 1 |
| 10 | 10 | 255 | 203 | 151 | 87 | 51 | 35 | 23 | 11 | 7 | 1 | 255 | 203 | 151 | 87 | 51 | 35 | 23 | 11 | 7 | 1 |
| 7 | 7 | 255 | 203 | 151 | 87 | 51 | 35 | 23 | 11 | 7 | 1 | 255 | 203 | 151 | 87 | 51 | 35 | 23 | 11 | 7 | 1 |
| 4 | 4 | 255 | 203 | 151 | 87 | 51 | 35 | 23 | 11 | 7 | 1 | 255 | 203 | 151 | 87 | 51 | 35 | 23 | 11 | 7 | 1 |
| 2 | 2 | 255 | 203 | 151 | 87 | 51 | 35 | 23 | 11 | 7 | 1 | 255 | 203 | 151 | 87 | 51 | 35 | 23 | 11 | 7 | 1 |

TABLE2

| DBV Band \|Nits\| | | Tab-Point | | | | | | | | | | | | | | | | | | | |
|---|---|---|---|---|---|---|---|---|---|---|---|---|---|---|---|---|---|---|---|---|---|
| 60Hz | 48Hz | 60Hz | | | | | | | | | | 48Hz | | | | | | | | | |
| 300 | 300 | 255 | 203 | 151 | 87 | 51 | 35 | 23 | 11 | 7 | 1 | 255 | – | – | – | 51 | – | 23 | 11 | – | – |
| 100 | 100 | 255 | 203 | 151 | 87 | 51 | 35 | 23 | 11 | 7 | 1 | 255 | – | – | – | 51 | – | 23 | 11 | – | – |
| 60 | 60 | 255 | 203 | 151 | 87 | 51 | 35 | 23 | 11 | 7 | 1 | 255 | – | – | – | 51 | – | 23 | 11 | – | – |
| 30 | 30 | 255 | 203 | 151 | 87 | 51 | 35 | 23 | 11 | 7 | 1 | 255 | – | – | – | 51 | – | 23 | 11 | – | – |
| 15 | 15 | 255 | 203 | 151 | 87 | 51 | 35 | 23 | 11 | 7 | 1 | 255 | – | – | – | 51 | – | 23 | 11 | – | – |
| 10 | 10 | 255 | 203 | 151 | 87 | 51 | 35 | 23 | 11 | 7 | 1 | 255 | – | – | – | 51 | – | 23 | 11 | – | – |
| 7 | 7 | 255 | 203 | 151 | 87 | 51 | 35 | 23 | 11 | 7 | 1 | 255 | – | – | – | 51 | – | 23 | 11 | – | – |
| 4 | 4 | 255 | 203 | 151 | 87 | 51 | 35 | 23 | 11 | 7 | 1 | 255 | – | – | – | 51 | – | 23 | 11 | – | – |
| 2 | 2 | 255 | 203 | 151 | 87 | 51 | 35 | 23 | 11 | 7 | 1 | 255 | – | – | – | 51 | – | 23 | 11 | – | – |

SOURCE DRIVER AND DISPLAY DEVICE INCLUDING THE SAME

CROSS-REFERENCE TO RELATED APPLICATION

This application claims priority to and the benefit of Korean Patent Application No. 10-2019-0019335, filed in the Korean Intellectual Property Office on Feb. 19, 2019, the entire contents of which are herein incorporated by reference.

TECHNICAL FIELD

The present disclosure relates to a display device and, more specifically, to a source driver and a display device including the source driver.

DISCUSSION OF THE RELATED ART

A display device generally includes a source driver and a display panel. The source driver generates a gamma voltage representative of each possible gray scale value and converts externally-provided digital input data into analog data signals using the gamma voltages. Pixels included in the display panel emit light with a luminance corresponding to the data signals that are provided thereto.

The source driver sets reference gamma voltages corresponding to the respective gray scale values based on gamma characteristics of the pixels and divides the reference gamma voltages to generate the gamma voltage for each gray scale value.

SUMMARY OF THE INVENTION

A display device operates while varying a drive frequency so as to reduce power consumption. However, in changing the drive frequency, optical characteristics of the display device may change and these changes may be observable to a viewer thereby reducing perceived image quality.

An exemplary embodiment of the present invention provides a source driver capable of maintaining constant optical characteristics even if the drive frequency is variable, and a display device including the source driver.

A source driver, according to one exemplary embodiment of the present invention, includes a gamma voltage generation circuit. The gamma voltage generation circuit generates a gamma voltage and varies the gamma voltage based on a drive frequency. The data voltage generation circuit generates a data voltage based on the gamma voltage.

According to an exemplary embodiment of the present invention, the source driver may further include a frequency determination circuit which determines the drive frequency based on image data.

According to an exemplary embodiment of the present invention, the gamma voltage generation circuit may include a first gamma voltage generator, which generates first gamma voltages based on reference gamma voltages set corresponding to a reference frequency, an offset setter, which generates gamma voltage offsets based on reference gamma voltage offsets set corresponding to the drive frequency, and a second gamma voltage generator, which generates second gamma voltages based on the first gamma voltages and the gamma voltage offsets. The number of the reference gamma voltage offsets may be smaller than the number of the gamma voltage offsets. The number of the second gamma voltages may be equal to the number of the gamma voltage offsets.

According to an exemplary embodiment of the present invention, the number of the reference gamma voltage offsets may be smaller than the number of the reference gamma voltages.

According to an exemplary embodiment of the present invention, the offset setter may generate the gamma voltage offsets by interpolating the reference gamma voltage offsets.

According to an exemplary embodiment of the present invention, the offset setter may determine a first adjacent frequency and a second adjacent frequency, which are adjacent to the drive frequency, and may set the reference gamma voltage offsets by interpolating preset first adjacent reference gamma offsets corresponding to the first adjacent frequency and preset second adjacent reference gamma offsets corresponding to the second adjacent frequency.

According to an exemplary embodiment of the present invention, the gamma voltage generation circuit may further include a selector which outputs either the first gamma voltages or the second gamma voltages.

According to an exemplary embodiment of the present invention, the reference gamma voltage offsets may include first color reference gamma voltage offsets, second color reference gamma voltage offsets, and third color reference gamma voltage offsets.

According to an exemplary embodiment of the present invention, the reference gamma voltage offsets may be inflection points of a curved line configured by the gamma voltage offsets.

According to an exemplary embodiment of the present invention, the gamma voltage generation circuit may further include a memory device which stores information on the reference gamma voltages and information on the reference gamma voltage offsets.

According to an exemplary embodiment of the present invention, the gamma voltage generation circuit may include an offset setter which generates second reference gamma voltage offsets based on first reference gamma voltage offsets set corresponding to the drive frequency, a gamma voltage control signal generator which sets second reference gamma voltages based on preset first reference gamma voltages and the second reference gamma voltage offsets, and a gamma voltage generator which generates second gamma voltages based on the second reference gamma voltages. The number of the first reference gamma voltage offsets may be smaller than the number of the second reference gamma voltage offsets. The number of the first reference gamma voltages may be equal to the number of the second reference gamma voltage offsets.

According to an exemplary embodiment of the present invention, the offset setter may generate the second reference gamma voltage offsets by interpolating the first reference gamma voltage offsets. The gamma voltage control signal generator may generate the second reference gamma voltages by summing the first reference gamma voltages and the second reference gamma voltage offsets together.

A display device according to an exemplary embodiment of the present invention includes a display unit. The display unit includes pixels. A source driver generates a data voltage based on image data and provides the data voltage to the pixels. The source driver includes a gamma voltage generation circuit which generates a gamma voltage and varies the gamma voltage based on a drive frequency. A data voltage generation circuit generates a data voltage based on the gamma voltage.

According to an exemplary embodiment of the present invention, the gamma voltage generation circuit may include a first gamma voltage generator which generates first gamma voltages based on reference gamma voltages set corresponding to a reference frequency. An offset setter generates gamma voltage offsets based on reference gamma voltage offsets set corresponding to the drive frequency. A second gamma voltage generator generates second gamma voltages based on the first gamma voltages and the gamma voltage offsets. The number of the reference gamma voltage offsets may be smaller than the number of the gamma voltage offsets. The number of the second gamma voltages may be equal to the number of the gamma voltage offsets. The number of the reference gamma voltage offsets may be smaller than the number of reference gamma voltages.

According to an exemplary embodiment of the present invention, the offset setter may generate the gamma voltage offsets by interpolating the reference gamma voltage offsets.

A source driver and a display device, according to exemplary embodiments of the present invention, varies gamma voltages according to variation of a drive frequency, and thereby, optical characteristics may be maintained constant.

In addition, the source driver and the display device may each store reference gamma voltage offsets corresponding to a part of the entire set of gray scale values, calculate gamma voltage offsets for the entire set of gray scale values by interpolating reference gamma voltage offsets, and generate gamma voltages corresponding to a variable frequency by adding the gamma voltage offsets to the gamma voltages corresponding to a reference frequency. Since only the reference gamma voltage offsets are set and stored, manufacturing costs of the source driver and the display device may be reduced.

A display device includes a display unit including a plurality of pixels. A scan driver is configured to generate scan signals for the display unit. A data driver is configured to generate data signals for the display unit. The data driver includes a drive frequency determination circuit configured to determine a drive frequency for the display unit, a gamma voltage generation circuit configured to generate a gamma voltage that depends upon the determined drive frequency for the display unit, and a data voltage generation circuit configured to generate the data signals based on the generated gamma voltage.

BRIEF DESCRIPTION OF THE DRAWINGS

A more complete appreciation of the present disclosure and many of the attendant aspects thereof will be readily obtained as the same becomes better understood by reference to the following detailed description when considered in connection with the accompanying drawings, wherein:

FIG. 4B is a diagram illustrating relationships between gamma voltages according to a reference frequency and gamma voltages according to a variable frequency;

FIG. 6 is a diagram illustrating an example of tap points used for setting the gamma voltages of FIG. 4B;

DETAILED DESCRIPTION OF THE EMBODIMENTS

Figure 1:
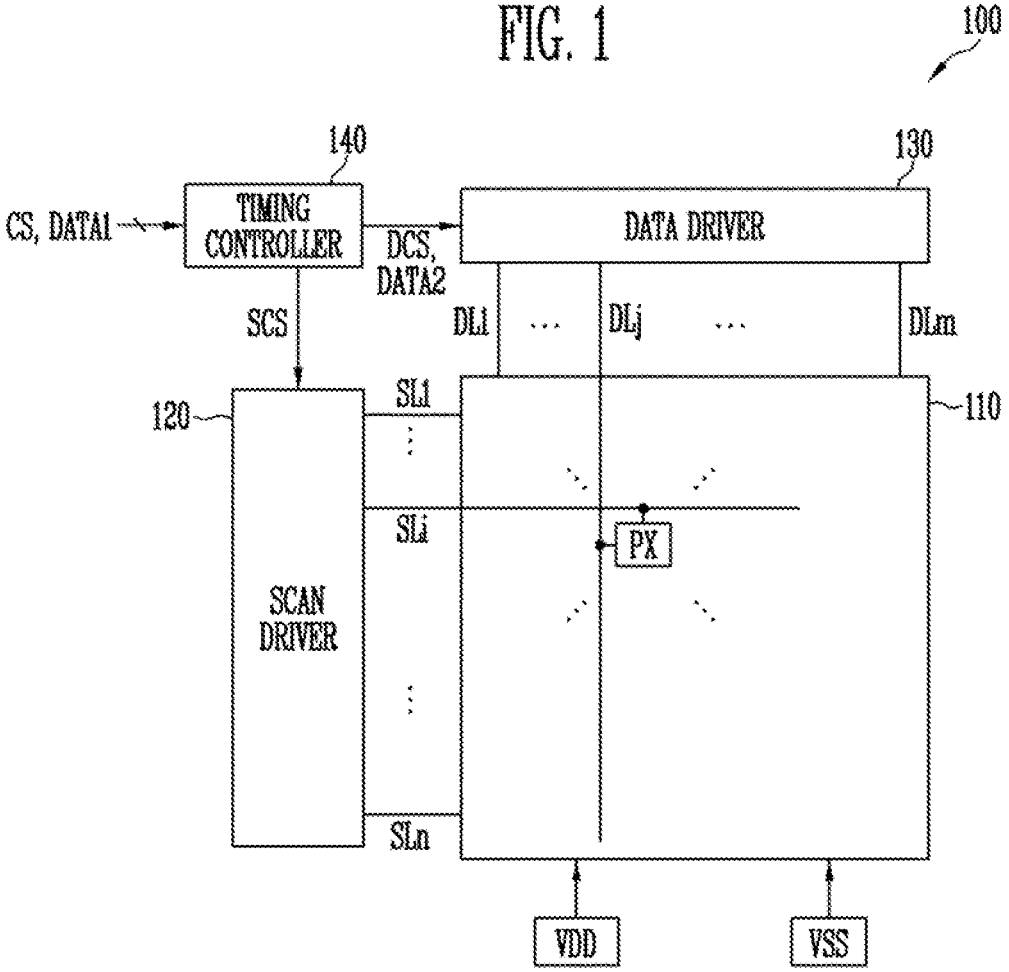
FIG. 1 is a block diagram illustrating a display device according to an exemplary embodiment of the present invention.

Hereinafter, various exemplary embodiments of the present invention will be described in detail with reference to the accompanying drawings such that those skilled in the art may easily perform the present invention. The present invention may be embodied in many different forms and is not limited to the exemplary embodiments described herein.

In the drawings and the description thereof, the same or similar reference numerals may be used to describe the same or similar elements. Moreover, to the extent that a detailed description of various elements is omitted, it may be assumed that those elements that are not described in detail are at least similar to corresponding elements that have been described in detail elsewhere in the disclosure and figures.

FIG. 1 is a diagram illustrating a display device according to an exemplary embodiment of the present invention.

Referring to FIG. 1, a display device 100 includes a display unit 110, a scan driver 120 (that may also be called a gate driver), a data driver 130 (that may also be called a source driver), and a timing controller 140.

The display unit 110 (that may also be called a display panel) may include scan lines SL1 to SLn (where n is a positive integer), data lines DL1 to DLm (where m is a positive integer), and pixels PX. The pixels PX may be disposed in regions (for example, pixel regions) partitioned by the scan lines SL1 to SLn and the data lines DL1 to DLm.

Each of the pixels PX may be connected to one of the scan lines SL1 to SLn and to one of the data lines DL1 to DLm. For example, the illustrated pixel PX may be connected to the scan line SL1 and the data line DLj (where each of i and j are particular positive integers). While only one of the pixels PX is shown, it is to be understood that there is one pixel PX for each possible combination of the scan lines SL1 to SLn and the data lines DL1 to DLm.

The pixel PX may emit light with a luminance corresponding to a data signal provided through the data line DLj in response to a scan signal provided through the scan line SL1.

The scan driver 120 generates scan signals in response to a scan control signal SCS and sequentially provides the scan signals to the scan lines SL1 to SLn. Here, the scan control signal SCS includes a start signal, clock signals, and the like, and may be provided from the timing controller 140. For example, the scan driver 120 may include a shift register that sequentially generates and outputs a pulse-shaped scan signal corresponding to the pulse-shaped start signal in response to the clock signals.

The data driver 130 may generate data signals in response to image data DATA2 and data control signal DCS provided from the timing controller 140 and output the data signals to the display unit 110 (or the pixels PX). Here, the data control signal DCS controls an operation of the data driver 130 and may include a load signal (or a data enable signal) for instructing that a valid data signal be output.

In exemplary embodiments of the present invention, the data driver 130 may generate gamma voltages corresponding to each possible value of the entire set of gray scale values and may convert the image data DATA2 into analog data signals using the gamma voltages.

In an exemplary embodiment of the present invention, the data driver 130 may vary a drive frequency based on the control of an external input signal or the image data DATA2 and may vary the gamma voltages based on the drive frequency. Here, the drive frequency is a frequency at which the data driver 130 is driven and may be the same as frequencies of output data signals. For example, the data driver 130 may vary the drive frequency from the reference frequency of 60 Hz to 48 Hz, 85 Hz, 120 Hz, and the like and may adjust the gamma voltages according to the varied drive frequency.

A configuration in which the data driver 130 varies the gamma voltages according to the variation of the drive frequency will be described below with reference to FIGS. 2 and 3.

The timing controller 140 may receive input image data DATA1 and a control signal CS from an external source (for example, a graphic processor), generate a scan control signal SCS and a data control signal DCS in response to the control signal CS, and convert the input image data DATA1 to generate the image data DATA2. For example, the timing controller 140 may convert the input image data DATA1, that may be in an RGB format, into the image data DATA2, that may be in an RGBG format, conforming to a pixel arrangement in the display unit 110.

The display unit 110 may receive first and second power supply voltages VDD and VSS. The power supply voltages VDD and VSS are voltages necessary for an operation of the pixel PX, and the first power supply voltage VDD may have a voltage level that is higher than a voltage level of the second power supply voltage VSS.

At least one of the scan driver 120, the data driver 130, and the timing controller 140 may be part of the display unit 110 or may be configured as an integrated circuit (IC) to be connected to the display unit 110 by a tape carrier package. In addition, at least two of the scan driver 120, the data driver 130, and the timing controller 140 may be configured as a single IC.

Figure 2:
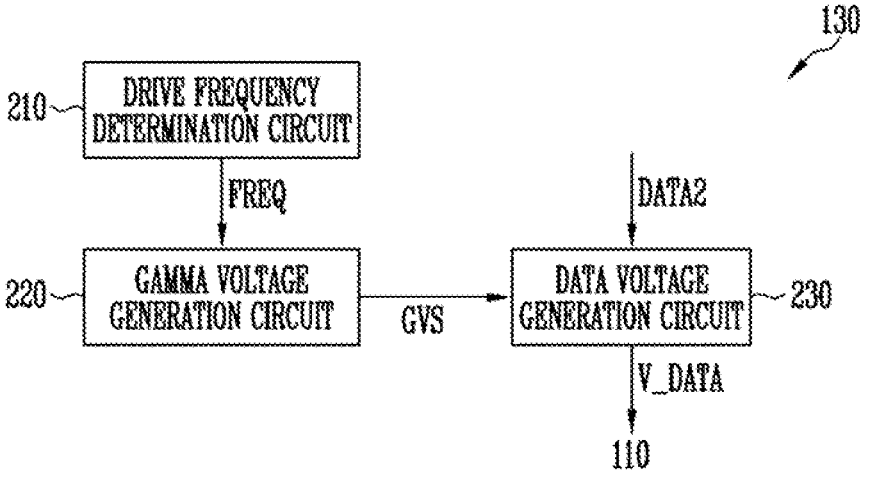
FIG. 2 is a block diagram illustrating an example of a data driver included in the display device of FIG. 1.

FIG. 2 is a block diagram illustrating an example of a data driver included in the display device of FIG. 1.

Referring to FIGS. 1 and 2, the data driver 130 may include a drive frequency determination circuit 210, a gamma voltage generation circuit 220, and a data voltage generation circuit 230.

The drive frequency determination circuit 210 may determine a drive frequency FREQ of the data driver 130. For example, the drive frequency determination circuit 210 may determine or vary the drive frequency FREQ in response to an external input (for example, a signal provided from the timing controller 140 and instructing that the drive frequency FREQ be varied). For example, the drive frequency determination circuit 210 may vary the drive frequency FREQ based on a transmission period of the image data DATA2. According to an exemplary embodiment of the present invention, the drive frequency determination circuit 210 may be omitted and the drive frequency FREQ may be provided from an external source (for example, the timing controller 140).

The gamma voltage generation circuit 220 may generate gamma voltages GVS and may vary the gamma voltages GVS based on the drive frequency FREQ. Here, the gamma voltages GVS correspond to each possible value of the entire set of gay scale values, respectively, and, for example, 256 gamma voltages GVS may be generated corresponding to 0 to 255 gray scale values. In addition, the gamma voltage generation circuit 220 may generate gamma voltages GVS for each sub-pixel. Here, the sub-pixel may be included in one pixel and emit light of a single color. For example, the sub-pixel may be a red sub-pixel emitting red light, a green sub-pixel emitting green light, or a blue sub-pixel emitting blue light.

The data voltage generation circuit 230 may generate a data voltage V_DATA based on the gamma voltages GVS and the image data DATA2. For example, the data voltage generation circuit 230 may include a shift register for transferring the image data DATA2, a data latch for latching the data received from the shift register, a digital-to-analog converter (DAC) for converting digital data transferred through the data latch into an analog data signal based on the gamma voltages, a buffer for outputting the data signal to an external source, and the like.

Figure 3:
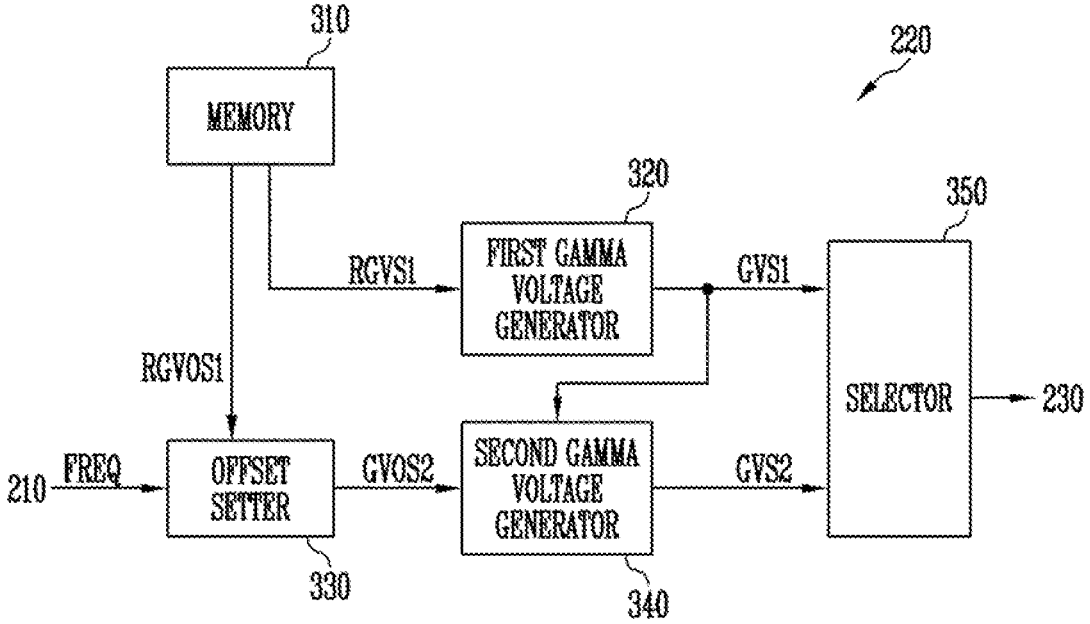
FIG. 3 is a block diagram illustrating an example of a gamma voltage generation circuit included in the data driver of FIG. 2.

FIG. 3 is a block diagram illustrating an example of the gamma voltage generation circuit included in the data driver of FIG. 2.

Referring to FIGS. 2 and 3, the gamma voltage generation circuit 220 may include a memory 310, a first gamma voltage generator 320, an offset setter 330, and a second gamma voltage generator 340. In addition, the gamma voltage generation circuit 220 may further include a selector 350. Each of these elements may be embodied as a circuit, with two or more of these elements being embodied on a single circuit.

The memory 310 (or a memory device) may store information on reference gamma voltages RGVS1 (or representative gamma voltages) for the reference frequency and information on reference gamma voltage offsets RGVOS1 (or reference gamma voltage offset values, representative gamma voltage offsets) for each of the possible drive frequencies (hereinafter, referred to as "variable frequencies") different from the reference frequency. Here, the reference frequency may be a general (or standard) drive frequency of the display device 100, for example, 60 Hz, and is not limited thereto. The reference gamma voltages RGVS1 for the reference frequency are a part of the first gamma voltages GVS1 generated by the gamma voltage generation circuit 220 when the data driver 130 is driven with the reference frequency, and for example, the reference gamma voltages RGVS1 may be 10 gamma voltages selected from among the 256 first gamma voltages GVS1. For example, the number of the reference gamma voltages RGVS1 may be smaller than the number of the first gamma voltages GVS1. The information on the reference gamma voltages RGVS1 may include values representing a voltage level of each of the reference gamma voltages RGVS1 or a selection value for selecting the reference gamma voltages RGVS1 from among a plurality of preset voltages.

Similarly, the variable frequencies (or changed frequencies) FREQ may be frequencies, which are different from the reference frequency, such as 48 Hz, 85 Hz, and 120 Hz. The reference gamma voltage offsets RGVOS1 for the variable frequencies FREQ may be values set for a part of the second gamma voltages GVS2 for the variable frequency FREQ on the basis of a part of the reference gamma voltages RGVS1 for the reference frequency. For example, the reference gamma voltage offsets RGVOS1 for the variable frequency FREQ may be voltage differences (for example, four voltage differences) between four gamma voltages selected from among the 256 second gamma voltages GVS2 and the reference gamma voltages (for example, four gamma voltages selected from among the 10 reference gamma voltages RGVS1) corresponding thereto. For example, the number of the reference gamma voltage offsets RGVOS1 may be smaller than the number of the second gamma voltages GVS2 and may be smaller than the number of the reference gamma voltages RGVS1 of the reference frequency. As will be described below, as the number of the reference gamma voltage offset RGVOS1 is smaller, a capacity of the memory 310 decreases, and the number of optical compensation steps that are required/time that is required (or takt time) for setting the reference gamma voltage offsets RGVOS1 in a manufacturing step is reduced, and thus, cost of the data driver 130 (and the display device 100) may be reduced.

The information on the reference gamma voltage offsets RGVOS1 may have the same form as the information on the reference gamma voltages RGVS1 of the reference frequency.

The first gamma voltage generator 320 may generate the first gamma voltages GVS1 based on the reference gamma voltages RGVS1 set corresponding to the reference frequency. For example, the first gamma voltage generator 320 may generate 10 reference gamma voltages RGVS1 based on the information on the 10 reference gamma voltages RGVS1 and generate 256 first gamma voltages GVS1 by dividing the 10 reference gamma voltages RGVS1. The first gamma voltage generator 320 is configured by a general gamma voltage generator and may include, for example, at least one resistance string coupled between a maximum reference voltage and a minimum reference voltage and a plurality of selectors (for example, multiplexers) that select a part of voltages divided by the at least one resistance string.

The offset setter 330 (or offset generator, offset calculator) may generate the gamma voltage offsets GVOS2 based on the reference gamma voltage offsets RGVOS1 set corresponding to the variable frequency FREQ. Here, the variable frequency FREQ (or information on the variable frequency FREQ) may be provided from the drive frequency determination circuit 210. For example, the offset setter 330 may interpolate the four reference gamma voltage offsets RGVOS1 to generate 256 gamma voltage offsets GVOS2.

The second gamma voltage generator 340 may generate the second gamma voltages GVS2 based on the first gamma voltages GVS1 and the gamma voltage offsets GVOS2. For example, the second gamma voltage generator 340 may add the 256 first gamma voltages GVS1 to the 256 gamma voltage offsets GVOS2 respectively to generate the 256 second gamma voltages GVS2.

The selector 350 may output either the first gamma voltages GVS1 or the second gamma voltages GVS2. For example, the selector 350 may preferentially output the second gamma voltages GVS2 and may output the first gamma voltages GVS1 when the second gamma voltages GVS2 are not applied.

As described by referring to FIG. 3, the gamma voltage generation circuit 220 may generate the second gamma voltages GVS2 for the variable frequency FREQ based on the reference gamma voltage offsets RGVOS1 set corresponding to the variable frequency FREQ and the first gamma voltages GVS1 for the reference frequency. Since the number of the reference gamma voltage offsets RGVOS1 is smaller than the number of the reference gamma voltages RGVS1 of the reference frequency, the number of times of optical compensation/required time (or takt time required to correct luminance/color coordinates) for setting the reference gamma voltage offsets RGVOS1 in a manufacturing step is reduced, and thus, cost of the data driver 130 (and the display device 100) may be reduced.

Figure 4A:
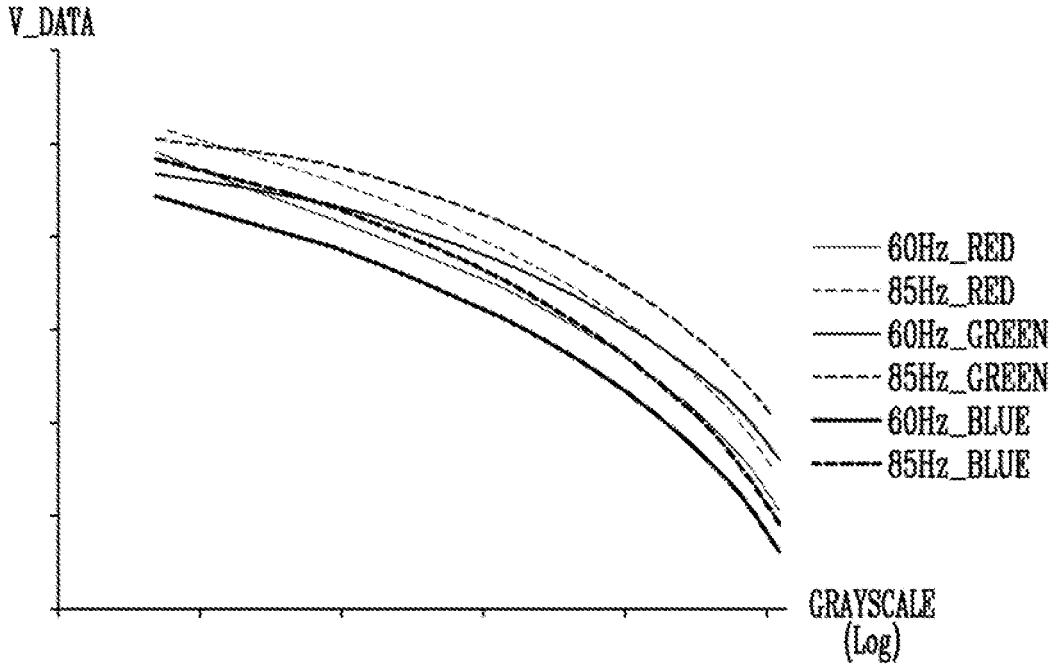
FIG. 4A is a diagram illustrating an example of a gamma voltage for each gray scale.

FIG. 4A is a diagram illustrating an example of the gamma voltages for each gray scale. FIG. 4B is a diagram illustrating relationships between the gamma voltages according to the reference frequency and the gamma voltages according to the variable frequency.

First, referring to FIG. 4A, a first frequency red gamma curved line 60 Hz_RED, a first frequency green gamma curved line 60 Hz_GREEN, a first frequency blue gamma curved line 60 Hz_BLUE, a second frequency red gamma curved line 85 Hz_RED, a second frequency green gamma curved line 85 Hz_GREEN, and a second frequency blue gamma curved line 85 Hz_BLUE are illustrated.

The first frequency red gamma curved line 60 Hz_RED, the first frequency green gamma curved line 60 Hz_GREEN, and the first frequency blue gamma curved line 60 Hz_BLUE represent gamma characteristics of a red sub-pixel, gamma characteristics of a green sub-pixel, and gamma characteristics of a blue sub-pixel, respectively, when the data driver 130 (see FIG. 1) is driven with a first drive frequency (or reference frequency) of 60 Hz. Similarly, the second frequency red gamma curved line 85 Hz_RED, the second frequency green gamma curved line 85 Hz_GREEN, and the second frequency blue gamma curved line 85 Hz_BLUE represent the gamma characteristics of the red sub-pixel, the gamma characteristics of the green sub-pixel, and the gamma characteristics of the blue sub-pixel, respectively, when the data driver 130 (see FIG. 1) is driven with a second drive frequency for variable frequency FREQ) of 85 Hz.

Referring to FIG. 4B, data voltages for the representative gray scale values, for example, the reference gamma voltages are illustrated according to the first frequency red gamma curved line 60 Hz_RED, the first frequency green gamma curved line 60 Hz_GREEN, the first frequency blue gamma curved line 60 Hz_BLUE, the second frequency red gamma curved line 85 Hz_RED, the second frequency green gamma curved line 85 Hz_GREEN, and the second frequency blue gamma curved line 85 Hz_BLUE which are illustrated in FIG. 4A. Here, the representative gray scale values correspond to characteristic points (for example, inflection points) on the first frequency red gamma curved line 60 Hz_RED, the first frequency green gamma curved line 60 Hz_GREEN, the first frequency blue gamma curved line 60 Hz_BLUE, the second frequency red gamma curved line 85 Hz_RED, the second frequency green gamma curved line 85 Hz_GREEN, and the second frequency blue gamma curved line 85 Hz_BLUE. For example, the representative gray scale values may include gray scale values of 11, 23, 35, 51, 87, 151, 203, and 255 among 0 to 255 gray scale values, but these gray scale values are examples and the representative gray scale values are not limited thereto.

On the first frequency red gamma curved line 60 Hz_RED, the first frequency green gamma curved line 60 Hz_GREEN, the first frequency blue gamma curved line 60 Hz_BLUE, the second frequency red gamma curved line 85 Hz_RED, the second frequency green gamma curved line 85 Hz_GREEN, and the second frequency blue gamma curved line 85 Hz_BLUE, as the gray scale increases, a data voltage V_DATA decreases, which exemplifies a case in which the sub-pixel (or the pixel PX of FIG. 1) includes a p-type transistor, and the present invention is not limited thereto.

As illustrated in FIGS. 4A and 4B, the first frequency red gamma curved line 60 Hz_RED, the first frequency green gamma curved line 60 Hz_GREEN, and the first frequency blue gamma curved line 60 Hz_BLUE may have data voltages different from each other for one gray scale (or the same gray scale). Accordingly, the reference gamma voltages RGVS1 described with reference to FIG. 3 are set for each sub-pixel, and the first gamma voltages GVS1 may be generated for each sub-pixel.

Similarly, the second frequency red gamma curved line 85 Hz_RED, the second frequency green gamma curved line 85 Hz_GREEN, and the second frequency blue gamma curved line 85 Hz_BLUE have the data voltages different from each other for one gray scale (or the same gray scale).

The first frequency red gamma curved line 60 Hz_RED and the second frequency red gamma curved line 85 Hz_RED may have the data voltages different from each other for one gray scale (or the same gray scale), even though the curved lines have the gamma characteristics for the same red sub-pixel. Accordingly, for driving the variable frequency FREQ of the display device 100, the second gamma voltages GVS2 (and setting values for generating the second gamma voltages GVS2) corresponding to the second frequency red gamma curved line 85 Hz_RED are required separately from the first gamma voltages GVS1 corresponding to the first frequency red gamma curved line 60 Hz_RED.

Since a relationship between the first frequency green gamma curved line 60 Hz_GREEN and the second frequency green gamma curved line 85 Hz_GREEN and a relationship between the first frequency blue gamma curved line 60 Hz_BLUE and the second frequency blue gamma curved line 85 Hz_BLUE are substantially the same as or similar to the relationship between the first frequency red gamma curved line 60 Hz_RED) and the second frequency red gamma curved line 85 Hz_RED, the duplicate description will not be repeated.

When data voltages RV_DATA (or the reference gamma voltages) on the second frequency red gamma curved line 85 Hz_RED or setting values corresponding thereto are all stored, the capacity of the memory 310 described with reference to FIG. 3 is increased, and a process (or required time of the process, takt time) for measuring or setting the data voltages RV_DATA on the second frequency red gamma curved line 85 Hz_RED may be increased.

Accordingly, the data driver 130 (or the display device 100) might store only the voltage differences (delta) (for example, the voltage differences (delta) set for each representative gray scale) between the data voltages RV_DATA (for example, the reference gamma voltages RGVS1) on the first frequency red gamma curved line 60 Hz_RED and the data voltages RV_DATA on the second frequency red gamma curved lines 85 Hz_RED, and the capacity of the memo 310 may be reduced.

In addition, the data driver 130 (or the display device 100) may select only a part of the voltage differences (delta) to determine as the reference gamma voltage offsets RGVOS1 (for example, the reference gamma voltage offsets RGVOS1 for the variable frequency FREQ of 85 Hz) described with reference to FIG. 3. For example, only the voltage differences (delta) corresponding to the gray scale values of 11, 23, 51, and 255 may be included in the reference gamma voltage offsets RGVOS1. The capacity of the memory 310 may be further reduced, in addition, in an optical compensation process, only the data voltages for a part of representative gray scale values corresponding to the reference gamma voltage offsets RGVOS1, rather than the entire representative gray scale values, are measured, and thus, the takt time may be further reduced.

Figure 5:
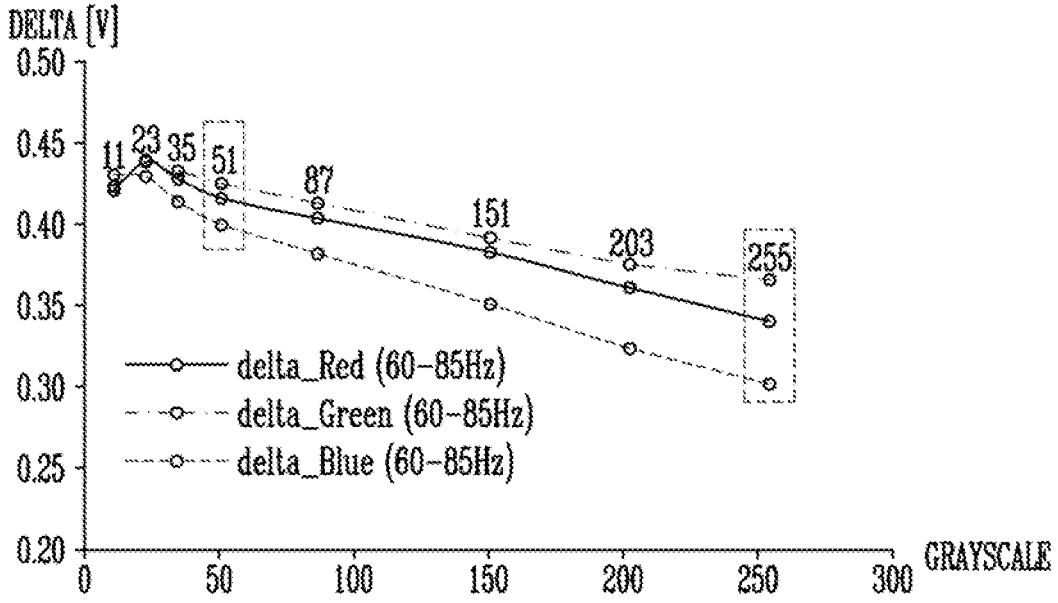
FIG. 5 is a graph illustrating differences between the gamma voltages according to the reference frequency and the gamma voltages according to the variable frequency.

FIG. 5 is described herein to illustrate the reference gamma voltage offsets RGVOS1 and a part of the representative gray scale values corresponding to the reference gamma voltage offsets RGVOS1.

FIG. 5 is a graph illustrating the differences between the gamma voltages according, to the reference frequency and the gamma voltages according, to the variable frequency FREQ. FIG. 5 illustrates a red delta curved line delta_RED, a green delta curved line delta_GREEN, and a blue delta curved line delta_BLUE for a variable frequency FREQ (for example, a drive frequency of 85 Hz). Each of the red delta curved line delta_RED, the green delta curved line delta_GREEN, and the blue delta curved line delta_BLUE may include the voltage difference (delta) (tor example, the voltage difference (delta) described with reference to FIG. 4B) in the entire gray scale range GRAYSCALE. Since the red delta curved line delta_RED, the green delta curved line delta_GREEN, and the blue delta curved line delta_BLUE have similar inflection characteristics, the red delta curved line delta_RED will be described as the representative for the red delta curved line delta_RED, the green delta curved line delta_GREEN, and the blue delta curved line delta_BLUE.

On the red delta curved line delta_RED, the voltage difference (delta) (or a difference voltage or a slope) starts to increase significantly at a point corresponding to the gray scale 11, the voltage difference (delta) is highest at a point corresponding to the gay scale 23 and starts to decrease significantly thereafter, the voltage difference (delta) starts to decrease gently at a point corresponding to the gray scale 51, and the voltage difference (delta) is lowest at a point corresponding to the gray scale 255.

Accordingly, the inflection points of the red delta curved line delta_RED may be set to the first color reference gamma voltage offsets. The voltage differences (delta) at the remaining points except the inflection points on the red delta curved line delta_RED may be calculated by interpolating the two reference gamma voltage offsets adjacent to the relevant point. Similarly, the inflection points of the green delta curved line delta_GREEN may be set to the second color reference gamma voltage offsets, and the inflection points of the blue delta curved line delta_BLUE may be set to the third color reference gamma voltage offsets. The first color reference gamma voltage offsets, the second color reference gamma voltage offsets, and the third color reference gamma voltage offsets may be included in the reference gamma voltage offsets RGVOS1 described with reference to FIG. 3.

FIG. 6 is described herein to illustrate an effect of using the reference gamma voltage offsets RGVOS1 instead of the reference gamma voltages.

FIG. 6 is a diagram illustrating an example of tab-points used for setting the gamma voltages of FIG. 48. The tab-point is a gray scale point at which luminance is measured in an optical compensation process of the display device 100 and the setting values (or the reference gamma voltages and the voltage offsets) at the tab-point may be stored in the memory 310 (see. FIG. 3).

Referring to FIG. 6, a first lookup table TABLE1 and a second lookup table TABLE2 include the tab-points at a first drive frequency (or a reference frequency, for example, 60 Hz), and the tab-points at a second drive frequency (or a first variable frequency, for example, 48 Hz).

The first lookup table TABLE1 may include the first tab-points (for example, gray scale values) to be compensated or measured for each luminance value DRV of the display device 100. For example, in order for the display device 100 driven with the second drive frequency of 85 Hz to display an image with 300 nits, data voltages for the gray scale values of 1, 7, 11, 23.35, 151, 87, 51, 203, and 255, for example, a total of 10 gray scale values may be measured or compensated. When an optical compensation for the display device 100 is performed by using the first lookup table TABLE1, the takt time for the optical compensation may be increased in proportion to the number of variable frequencies FREQ.

The second lookup table TABLE2 may include second tab-points (for example, gray scale values) to be compensated or measured for each luminance value DRY of the display device 100. For, example, in order for the display device 100 driven with the second drive frequency of 85 Hz to display an image with 300 nits, data voltages for the gray scale values of 11, 23, 51, and 255, for example, the total four gray scale values may be measured or compensated. When an optical compensation for the display device 100 is performed by using the second lookup table TABLE2, the tack time for the optical compensation may be reduced to 70% of the tack time of the optical compensation in which the first look-up table TAB LEI is used, and as the number of variable frequencies FREQ increases, the takt time for the optical compensation may be smaller so as to be less than or equal to a half of the takt time of the optical compensation in which the first look-up table TABLE1 is used.

In addition, the capacity of the memory 310 (see FIG. 3) which stores the information on the reference gamma voltages RGVS1 (see FIG. 3) and the reference gamma voltage offsets RGVOS1 (see FIG. 3) corresponding to the second lookup table TABLE2 may be smaller so as to be less than or equal to a half of the capacity of the memory corresponding to the first lookup table TABLE1.

As described with reference to FIGS. 4A to 6, the gamma voltages are generated by using the reference gamma voltage offsets for a part of the representative gray scale values, and thereby, the capacity of the memory 310 which stores the setting values (for example, the reference gamma voltages and the reference gamma voltage offsets) for generating the gamma voltages may be reduced, and the takt time for the optical compensation may be reduced.

Figure 7:
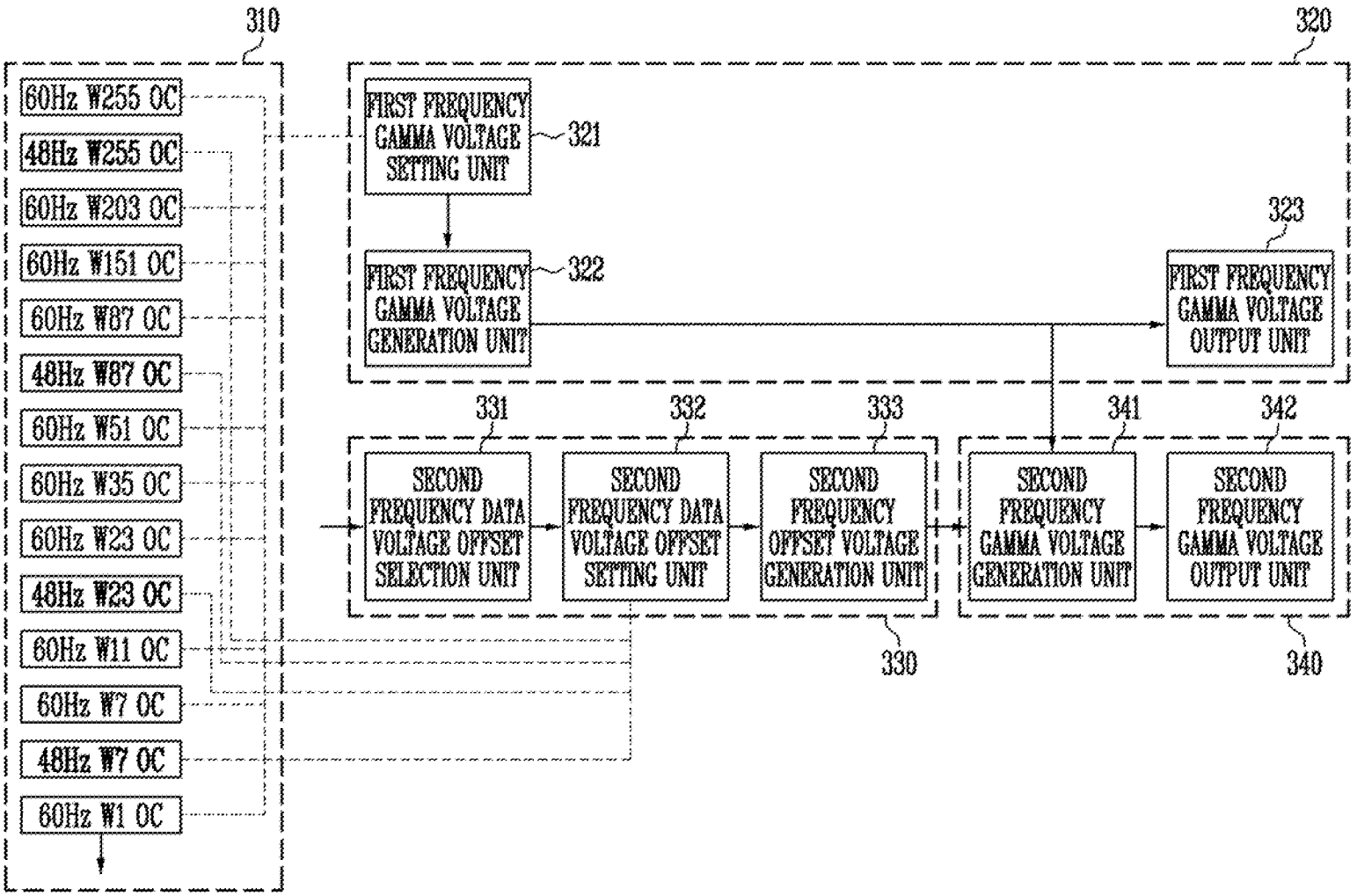
FIG. 7 is a block diagram illustrating an example of the gamma voltage generation circuit of FIG. 3.

FIG. 7 is a block diagram illustrating an example of the gamma voltage generation circuit of FIG. 3.

Referring to FIGS. 3 and 7, the memory 310 may store the information on the reference gamma voltages RGVS1 for the reference frequency and the information on the reference gamma voltage offsets RGVOS1 for the variable frequency FREQ. For example, the information on the reference gamma voltages RGVS1 for the reference frequency of 60 Hz may include a setting value W255 OC of the gray scale 255, a setting value W203 OC of the gray scale 203, a setting value W151 OC of the gray scale 151, a setting value W87 OC of the gray scale 87, a setting value W51 OC of the gray scale 51, a setting value W35 OC attic gray scale 35, a setting value W23 OC of the gray scale 23, a setting value W11 OC of the gray scale 11, a setting value W7 OC of the gray scale 7, and a setting value W1 OC of the gray scale 1. For example, the information on the reference gamma voltage offsets RGVOS1 for the variable frequency FREQ of 48 Hz may include the setting value W255 OC of the gray scale 255, the setting value W87 OC of the gray scale 87, the setting value W23 OC of the gray scale 23, and the setting value W7 OC of the gray scale 7.

The first gamma voltage generator 320 may include a first frequency gamma voltage setting unit 321, a first frequency gamma voltage generation unit 322, and a first frequency gamma voltage output unit 323.

The first frequency gamma voltage setting unit 321 may generate the reference gamma voltages RGVS1 based on the information on the reference gamma voltages RGVS1. For example, the first frequency gamma voltage setting unit 321 may generate the reference gamma voltages RGVS1 by dividing a maximum reference voltage and a minimum reference voltage based on the information on the reference gamma voltages RGVS1.

The first frequency gamma voltage generation unit 322 may generate the first gamma voltages GVS1 based on the reference gamma voltages RGVS1. For example, the first frequency gamma voltage generation unit 322 may generate the first gamma voltages GVS1 for the entire set of gray scale values by dividing the reference gamma voltages RGVS1.

The first frequency gamma voltage output unit 323 may provide the first gamma voltages GVS1 to the selector 350 or the data voltage generation circuit 230 (see FIG. 2).

The offset setter 330 may include a second frequency data voltage offset selection unit 331, a second frequency data voltage offset setting unit 332, and a second frequency offset voltage generation unit 333.

The second frequency data voltage offset selection unit 331 may acquire the information on the reference gamma voltage offsets RGVOS1 based on the variable frequency FREQ.

According to exemplary embodiments of the present invention, the second frequency data voltage offset selection unit 331 (or the offset setter 330) may determine a first adjacent frequency and a second adjacent frequency that are adjacent to a specific drive frequency and set the reference gamma voltage offsets corresponding to the specific drive frequency by interpolating a preset first adjacent reference gamma voltage offsets corresponding to the first adjacent frequency and a preset second adjacent reference gamma voltage offsets corresponding to the second adjacent frequency. Here, the first adjacent reference gamma voltage offsets corresponding to the first adjacent frequency and the second adjacent reference gamma voltage offsets cot-responding to the second adjacent frequency may be stored in the memory 310, and the reference gamma voltage offsets corresponding to the specific drive frequency might not be stored in memory 310.

Figure 8:
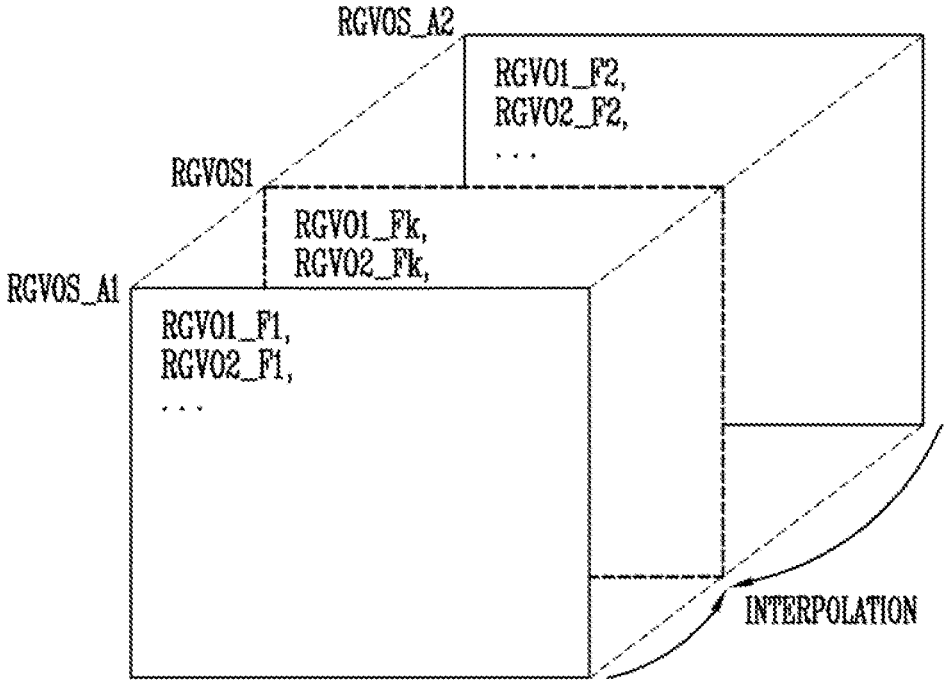
FIG. 8 is a diagram illustrating an example of gamma voltage offset set by an offset setter included in the gamma voltage generation circuit of FIG. 7.

FIG. 8 may be referenced to describe a configuration in which the reference gamma voltage offsets are set by using the first and second adjacent frequencies.

FIG. 8 is a diagram illustrating an example of the gamma voltage offsets set by the offset setter included in the gamma voltage generation circuit of FIG. 7.

Referring to FIG. 8, when the reference gamma voltage offsets RGVOS1 for a k-th drive frequency Fk (where k is a positive integer) are not stored in the memory 310, the second frequency data voltage offset selection unit 331 (or the offset setter 330) may determine a first adjacent frequency F1 and a second adjacent frequency F2 which are adjacent to the k-th drive frequency Fk and may set the reference gamma voltage offsets by interpolating a preset first adjacent reference gamma voltage offsets RGVOS_A1 corresponding to the first adjacent frequency F1 and a preset second adjacent reference gamma voltage offsets RGVOS_A2 corresponding to the second adjacent frequency F2. For example, the first reference gamma voltage offset RGVO_Fk for the k-th drive frequency Fk may be determined by interpolating the first reference gamma voltage offsets RGVO1_F1 included in the first adjacent reference gamma voltage offsets RGVOS_A1 and the first reference gamma voltage offsets RGVO1_F2 included in the second adjacent reference gamma voltage offsets RGVOS_A2 based on the k-th drive frequency Fk. Accordingly, it is possible to reduce the capacity of the memory 310, the takt time, the cost of the data driver 130 (and the display device 100), and the like.

Referring to FIG. 7 again, the second frequency data voltage offset setting unit 332 may generate reference gamma voltage offsets RGVOS1 based on the information on the reference gamma voltage offsets RGVOS1.

The second frequency offset voltage generation unit 333 may generate gamma voltage offsets GVOS2 based on the reference gamma voltage offsets RGVOS1. For example, the second frequency offset voltage generation unit 333 may generate the gamma voltage offsets GVOS2 for the entire set of gray scale values by dividing the reference gamma voltage offsets RGVOS1.

The second gamma voltage generator 340 may include a second frequency gamma voltage generation unit 341 and a second frequency gamma voltage output unit 342.

The second frequency gamma voltage generation unit 341 may generate the second gamma voltages GVS2 based on the first gamma voltages GVS1 and the gamma voltage offsets GVOS2. For example, the second frequency gamma voltage generation unit 341 may generate the second gamma voltages GVS2 by summing the first gamma voltages GVS1 and the gamma voltage offsets GVOS2.

The second frequency gamma voltage output unit 342 may provide the second gamma voltages GVS2 to the selector 350 or the data voltage generation circuit 230 (see FIG. 2).

As described with reference to FIGS. 7 and 8, the gamma voltage generation circuit 220 may calculate the reference gamma voltage offsets corresponding to a specific drive frequency by interpolating the reference gamma voltage offsets set corresponding to adjacent frequencies. Accordingly, it is possible to reduce the capacity of the memory 310, the takt time, the cost of the data driver 130 (and the display device 100), and the like.

Figure 9:
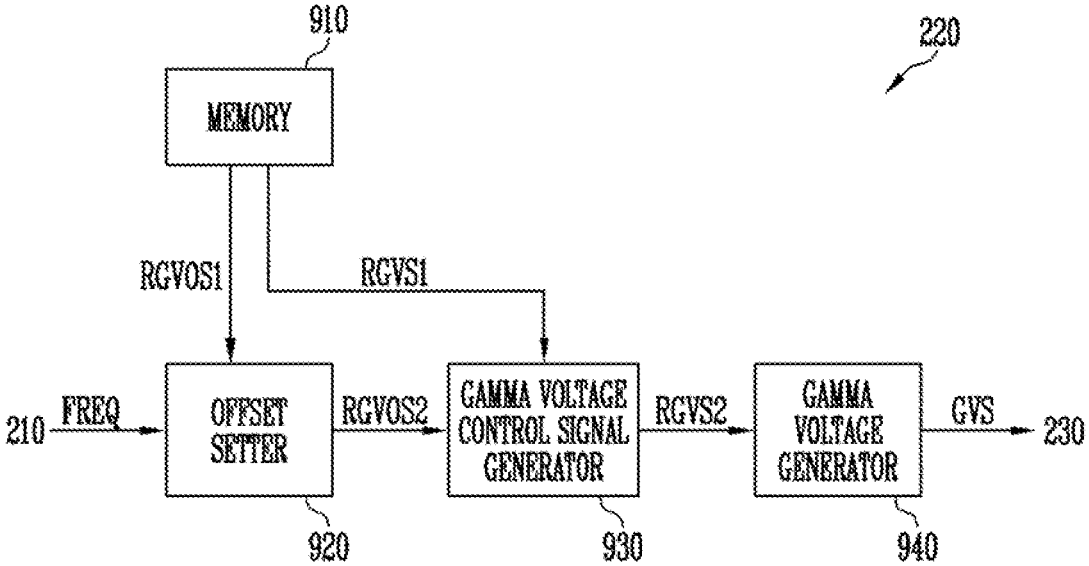
FIG. 9 is a block diagram illustrating another example of the gamma voltage generation circuit included in the data driver of FIG. 2.

FIG. 9 is a block diagram illustrating another example of the gamma voltage generation circuit included in the data driver of FIG. 2.

Referring to FIGS. 2, 3, and 9, the gamma voltage generation circuit 220 may include a memory 910 (or a storage unit), an offset setter 920, a gamma voltage control signal generator 930, and a gamma voltage generator 940. The memory 910, the offset setter 920, and the gamma voltage generator 940 may be substantially the same as or similar to the memory 310, the offset setter 330, and the first gamma voltage generator 320, which are described with reference to FIG. 3, respectively, and thus, the duplicate description will not be repeated.

The offset setter 920 may generate the second reference gamma voltage offsets RGVOS2 based on the first reference gamma voltage offsets RGVOS1 set corresponding to the variable frequency FREQ. Here, the first reference gamma voltage offsets RGVOS1 are substantially the same as the reference gamma voltage offsets RGVOS1 described with reference to FIG. 3, and may include, for example, offsets for four representative gray scale values selected from among ten representative gray scale values. The second reference gamma voltage offsets RGVOS2 may include offsets corresponding to the first reference gamma voltages RGVS1 (for example, the reference gamma voltages RGVS1 described with reference to FIG. 3), and may include, for example, offsets for the 10 representative gray scale values.

For example, the offset setter 920 may generate the second reference gamma voltage offsets RGVOS2 by interpolating or extrapolating the first reference gamma voltage offsets RGVOS1 based on the representative gray scale values.

The gamma voltage control signal generator 930 may generate setting values (or a control signal) of the second reference gamma voltages RGVS2 corresponding to the variable frequency FREQ, based on the second reference gamma voltage offsets RGVOS2 and the first reference gamma voltages RGVS1 (or the setting values of the first reference gamma voltages RGVS1) corresponding to the reference frequency.

For example, the gamma voltage control signal generator 930 may generate setting values of the second reference gamma voltages RGVS2 by adding the second reference gamma voltage offsets RGVOS2 to the setting values of the first reference gamma voltages RGVS1, respectively.

The gamma voltage generator 940 may generate the gamma voltages GVS (or the gamma voltages corresponding to the variable frequency FREQ) for the entire set of gray scale values based on the setting values of the second reference gamma voltages RGVS2.

For example, the gamma voltage generation circuit 220 described with reference to FIG. 3 may generate the first gamma voltages GVS1 and the second gamma voltages GVS2 by using the first gamma voltage generator 320 and the second gamma voltage generator 340, and the gamma voltage generation circuit 220 illustrated in FIG. 9 may generate the gamma voltages GVS by using one gamma voltage generator 940.

Figure 10:
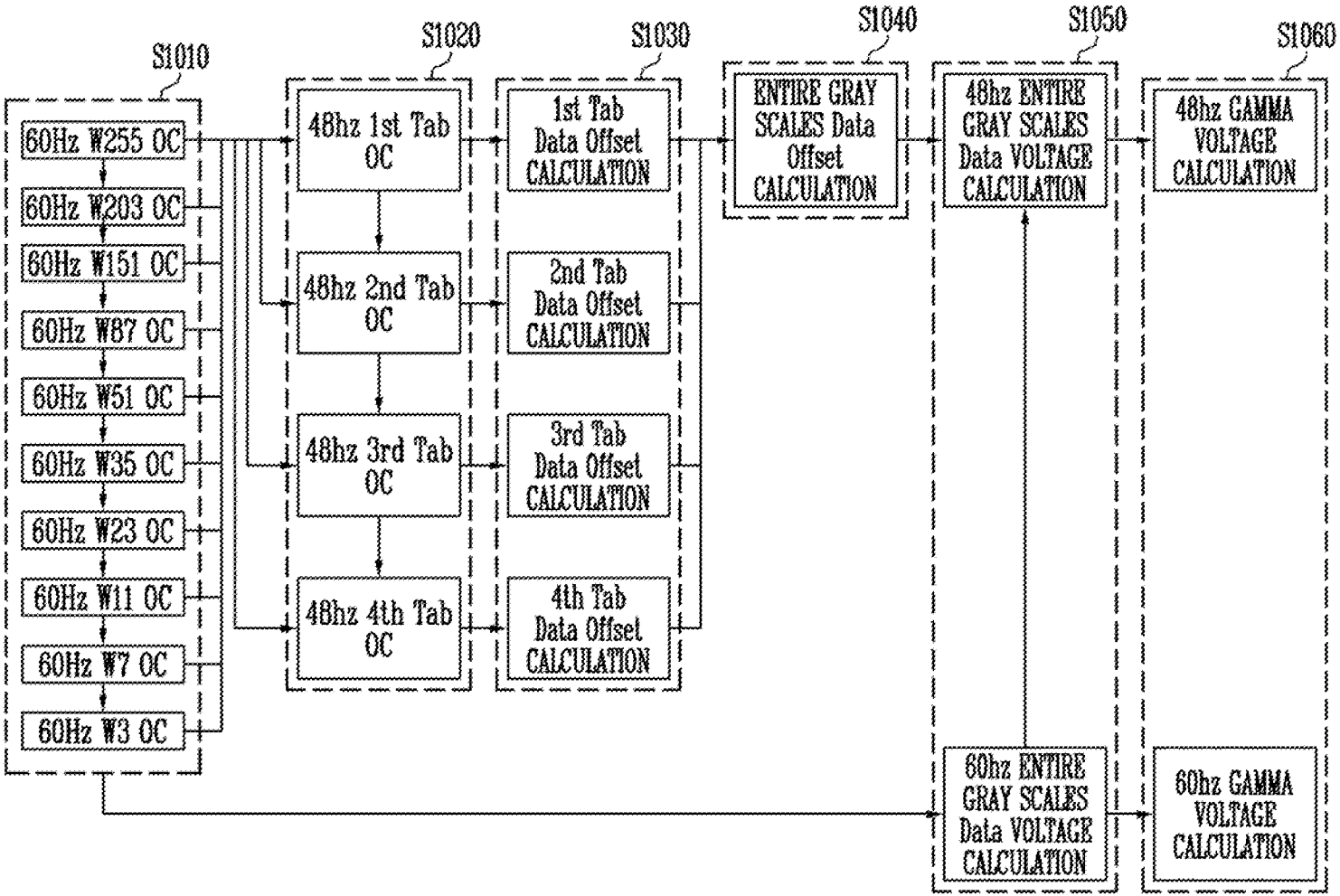
FIG. 10 is a sequence diagram illustrating an example of an optical compensation method of performing an optical compensation for the display device of FIG. 1.

FIG. 10 is a sequence diagram illustrating an example of an optical compensation method of performing an optical compensation for the display device of FIG. 1.

Referring to FIGS. 1, 2, 3, 4B, and 10, in the method of FIG. 10 optical compensation values may be calculated based on the tab-points at the first drive frequency (for example, 60 Hz) included in the second lookup table TABLE2 illustrated in FIG. 4B (S1010).

For example, in the method of FIG. 10, an image may be displayed for each gray scale value (or luminance) through the display device 100, the luminance of at least a region of the display device 100 may be measured through an image capturing device, and the data voltages may be adjusted such that luminance/color coordinate coincides with reference luminance/reference color coordinate. The adjusted data voltages (for example, the first data voltages) may be stored in the memory 310 as the reference gamma voltages RGVS1.

Subsequently, in the method of FIG. 10, optical compensation values may be calculated based on the tab-points at the second drive frequency (for example, 48 Hz) included in the second lookup table TABLE2 illustrated in FIG. 4B (S1020).

For example, in the method of FIG. 10, the second data voltages corresponding to four representative gray scale values may be set by displaying an image for each of the four representative gray scale values through the display device 100.

Subsequently, in the method of FIG. 10, the first reference gamma voltage offsets RGVOS1 may be calculated based on the second data voltages and a part (for example, the first data voltages corresponding to the representative gray scale values in which the second data voltages are obtained) of the first data voltages corresponding to the second data voltages (S1030).

For example, in the method of FIG. 10, each of the voltage differences between four second data voltages and four data voltages selected from among the first data voltages may be calculated, and the voltage differences may be determined as the first reference gamma voltage offsets RGVOS1. The first reference gamma voltage offsets RGVOS1 may be stored in the memory 310.

According to exemplary embodiments of the present invention, in the method of FIG. 10, the gamma voltage offsets for the entire set of gray scale values or the second reference gamma voltage offsets RGVOS2 for the representative gray scale values may be calculated based on the first reference gamma voltage offsets RGVOS1 (S1040).

For example, in the method of FIG. 10, 255 gamma voltage offsets GVOS2 for the entire set of gray scale values may be calculated by interpolating or extrapolating the four first reference gamma voltage offsets RGVOS1. For example, in the method of FIG. 10, ten second reference gamma voltage offsets RGVOS2 may be calculated by interpolating or extrapolating the four first reference gamma voltage offsets RGVOS1. In this case, then second reference gamma voltage offsets RGVOS2 may be stored in the memory 310.

According to an exemplary embodiment of the present invention, in the method of FIG. 10, the first gamma voltages GVS1 for the first drive frequency may be generated based on the reference gamma voltages RGVS1, and the second gamma voltages GVS2 for the second drive frequency may be generated based on the first gamma voltages GVS1 and the gamma voltage offsets GVOS2 (S1050).

For example, in the method of FIG. 10, the first gamma voltages may be generated by dividing the reference gamma voltages RGVS1 corresponding to the drive frequency of 60 Hz, and the second gamma voltages GVS2 may be generated by summing the first gamma voltages GVS1 and the gamma voltage offsets GVOS2, respectively.

Subsequently, in the method of FIG. 10, one of the first gamma voltages GVS1 and the second gamma voltages GVS2 may be output (S1060).

As described with reference to FIG. 10, in the optical compensation method, the optical compensation is performed only for a part of the representative gray scale values for the display device 100 driven at the second drive frequency FREQ or variable frequency), and thereby, tack time may be reduced.

The detailed description provided above and the corresponding drawings are merely exemplary and various modifications and equivalents are within the scope of the present invention.

What is claimed is:

1. A source driver for a display device, comprising:

a data driver configured to generate a gamma voltage, wherein the data driver is farther configured to vary the gamma voltage based on a drive frequency of the display device;

wherein the data driver is further configured to generate a data voltage for displaying image data on the display device based on the gamma voltage, wherein varying the gamma voltage based on the drive frequency of the display device includes offsetting first gamma voltages corresponding to a first drive frequency to obtain second gamma voltages corresponding to a second drive frequency, wherein the first frequency is a reference frequency that is an initial drive frequency of the display device, the first gamma voltages are reference gamma voltages, and the data driver is further configured to:

generate the first gamma voltages based on the reference gamma voltages that correspond to the reference frequency;

generate gamma voltage offsets based on reference gamma voltage offsets which correspond to the drive frequency of the display device; and generate second gamma voltages based on the first gamma voltages and the gamma voltage offsets, wherein a number of the reference gamma voltage offsets is smaller than a number of the gamma voltage offsets, wherein a number of the second gamma voltages is equal to the number of the gamma voltage offsets, and wherein the reference frequency is the initial drive frequency of the display device.

2. The source driver of claim 1, wherein the data driver is further configured to determine the drive frequency of the display device based on the image data.

3. The source driver of claim 1, wherein the number of the reference gamma voltage offsets is smaller than a number of the reference gamma voltages.

4. The source driver of claim 3, wherein the data driver is further configured to generate the gamma voltage offsets by interpolating the reference gamma voltage offsets.

5. The source driver of claim 3, wherein the data driver is further configured to determine a first adjacent frequency and a second adjacent frequency, which are adjacent to the drive frequency, and set the reference gamma voltage offsets by interpolating preset first adjacent reference gamma offsets corresponding to the first adjacent frequency and preset second adjacent reference gamma offsets corresponding to the second adjacent frequency.

6. The source driver of claim 3, wherein the data driver is further configured to output the first gamma voltages or the second gamma voltages.

7. The source driver of claim 3, wherein the reference gamma voltage offsets include first color reference gamma voltage offsets, second color reference gamma voltage offsets, and third color reference gamma voltage offsets.

8. The source driver of claim 3, wherein the reference gamma voltage offsets are inflection points of a curved line configured by the gamma voltage offsets.

9. The source driver of claim 1, wherein the data driver further includes a memory device configured to store information on the reference gamma voltages and information on the reference gamma voltage offsets.

10. A source driver for a display device, comprising:

a data driver configured to generate a gamma voltage, wherein the data driver is further configured to vary the gamma voltage based on a drive frequency of the display device;

wherein the data driver is further configured to generate a data voltage for displaying image data on the display device based on the gamma voltage, and wherein varying the gamma voltage based on the drive frequency of the display device includes offsetting first gamma voltages corresponding to a first drive frequency to obtain second gamma voltages corresponding to a second drive frequency, wherein the data driver is further configured to:

generate second reference gamma voltage offsets based on first reference gamma voltage offsets which correspond to the drive frequency;

set second reference gamma voltages based on first reference gamma voltages and the second reference gamma voltage offsets; and generate the second gamma voltages based on the second reference gamma voltages, wherein a number of the first reference gamma voltage offsets is smaller than a number of the second reference gamma voltage offsets, and wherein a number of the first reference gamma voltages is equal to the number of the second reference gamma voltage offsets.

11. The source driver of claim 10, wherein the data driver is further configured to generate the second reference gamma voltage offsets by interpolating the first reference gamma voltage offsets, and generate the second reference gamma voltages by respectively summing the first reference gamma voltages and the second reference gamma voltage offsets.

12. A method for driving a display device, comprising:

generating a data voltage, in a source driver, based on image data and providing the data voltage to a plurality of pixels of a display unit of the display device, wherein the source driver:

generates a gamma voltage by reading preset gamma voltages and varies the gamma voltage based on a drive frequency of the display device by offsetting the read preset gamma voltages; and generates a data voltage based on the gamma voltage, wherein the source driver;

generates first gamma voltages based on reference gamma voltages which correspond to a reference frequency;

generates gamma voltage offsets based on reference gamma voltage offsets which correspond to the drive frequency; and generates second gamma voltages lased on the first gamma voltages and the gamma voltage offsets, wherein a number of the reference gamma voltage offsets is smaller than a number of the gamma voltage offsets, wherein a number of the second gamma voltages is equal to the number of the gamma voltage offsets, wherein the number of the reference gamma voltage offsets is smaller than a number of reference gamma voltages, and wherein the reference frequency is an initial drive frequency of the display device.

13. The method for driving the display device of claim 12, wherein the source driver generates the gamma voltage offsets by interpolating the reference gamma voltage offsets.

14. A method for driving a display device, comprising:

generating scan signals for the display unit in a scan driver; and venerating data signals for the display unit in a data driver, wherein the data driver:

determines a drive frequency for the display unit;

generates a gamma voltage that depends upon the determined drive frequency for the display unit; and generates the data signals based on the generated gamma voltage, wherein the data driver:

generates first gamma voltages based on reference gamma voltages that correspond to a reference frequency;

generates gamma voltage offsets based on reference gamma voltage offsets which correspond to the drive frequency for the display device; and generates second gamma voltages based on the first gamma voltages and the gamma voltage offsets, wherein a number of the reference gamma voltage offsets is smaller than a number of the gamma voltage offsets, wherein a number of the second gamma voltages is, equal to the number of the gamma voltage offsets, wherein the number of the reference gamma voltage offsets is smaller than a number of the reference gamma voltages, and wherein the reference frequency is an initial drive frequency of the display device.

15. The method for driving the display device of claim 14, wherein the data driver determines a first adjacent frequency and a second adjacent frequency, which are adjacent to the drive frequency, and sets the reference gamma voltage offsets by interpolating preset first adjacent reference gamma offsets, corresponding to the first adjacent frequency and preset second adjacent reference gamma offsets corresponding to the second adjacent frequency.

16. The method for driving the display device of claim 14, wherein the reference gamma voltage offsets include first color reference gamma voltage offsets, second color reference gamma voltage offsets, and third color reference gamma voltage offsets.

17. The method for driving the display device of claim 14, wherein the data driver includes a memory device configured to store information on the reference gamma voltages and information on the reference gamma voltage offsets.

* * * * *